US009486018B2

(12) United States Patent
Coats, IV et al.

(10) Patent No.: US 9,486,018 B2
(45) Date of Patent: Nov. 8, 2016

(54) TORSO COOLING UNIT FOR PERSONAL WEAR

(71) Applicant: Safariland, LLC, Jacksonville, FL (US)

(72) Inventors: James Greene Coats, IV, Gainesville, FL (US); Brad Glass, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 563 days.

(21) Appl. No.: 13/905,736

(22) Filed: May 30, 2013

(65) Prior Publication Data

US 2013/0319031 A1 Dec. 5, 2013

Related U.S. Application Data

(60) Provisional application No. 61/653,841, filed on May 31, 2012.

(51) Int. Cl.
*A41D 13/002* (2006.01)

(52) U.S. Cl.
CPC ..... *A41D 13/0025* (2013.01)

(58) Field of Classification Search
CPC ..... F25D 2400/26; A41D 13/0025; A41D 13/0053; F25B 47/006
USPC ..... 62/150, 151, 154, 275, 276, 259.3
See application file for complete search history.

(56) References Cited

U.S. PATENT DOCUMENTS 2,731,808 A * 1/1956 Stark ..... A41D 13/0053 62/259.3
3,085,405 A * 4/1963 Frantti ..... A62B 17/005 62/259.3
3,429,138 A * 2/1969 Goldmerstein ..... F25D 7/00 62/259.3
3,487,765 A * 1/1970 Lang ..... F24F 5/00 62/259.3
4,580,408 A 4/1986 Stuebner
5,014,355 A * 5/1991 Vollenweider, II A41D 13/0025 62/259.3
5,090,053 A 2/1992 Hayes
5,146,625 A * 9/1992 Steele ..... A41D 13/0058 62/259.3
5,217,408 A * 6/1993 Kaine ..... A41D 13/0053 62/259.3
5,564,124 A * 10/1996 Elsherif ..... A41D 13/0025 62/259.3
5,970,519 A 10/1999 Weber (Continued)

FOREIGN PATENT DOCUMENTS

EP 0490347 A1 6/1992
WO 2011032288 A1 3/2011

OTHER PUBLICATIONS

PCT Appln. No. PCT/US2013/43372, Invitation to Pay Additional Fees and, Where Applicable Protest Fee dated Aug. 21, 2013.

(Continued)

*Primary Examiner* — Frantz Jules
*Assistant Examiner* — Nelson Nieves
(74) *Attorney, Agent, or Firm* — Kane Kessler, P.C.; Paul E. Szabo

(57) ABSTRACT

A cooling unit that can be used with or without a garment, such as a ballistic vest, that covers a user's torso when worn by the user. The cooling unit includes a fan for blowing ambient air; a manifold for distributing to the torso the air that is blown by the fan; and a hose for connecting the fan to the manifold. The manifold may be formed of three overlying panels that are secured together, including an outer panel, a central panel, and an inner panel that is closest to the user's torso when the cooling unit is being worn. No modification of the vest is necessary to accommodate the cooling unit.

4 Claims, 5 Drawing Sheets

(56) References Cited

U.S. PATENT DOCUMENTS

| | | | | |
|---|---|---|---|---|
| 6,295,648 | B2 | 10/2001 | Siman-Tov et al. | |
| 6,581,677 | B2 * | 6/2003 | Dukes-Dobos | G01N 25/18 62/259.3 |
| 6,892,392 | B2 | 5/2005 | Crye et al. | |
| 7,716,940 | B2 * | 5/2010 | Farnworth | A41D 13/0025 62/259.3 |
| 2005/0246826 | A1 | 11/2005 | McCarter | |
| 2007/0000008 | A1 | 1/2007 | Sawicki | |
| 2008/0141428 | A1 * | 6/2008 | Kapah | A41D 13/0025 2/2.5 |
| 2010/0125928 | A1 * | 5/2010 | Smith | A41D 13/0025 2/69 |
| 2010/0242147 | A1 | 9/2010 | Pohr | |

OTHER PUBLICATIONS

PCT Appln. No. PCT/US2013/043372, International Search Report and Written Opinion dated Jan. 3, 2014.
Prior Art Body Ventilation System.

* cited by examiner

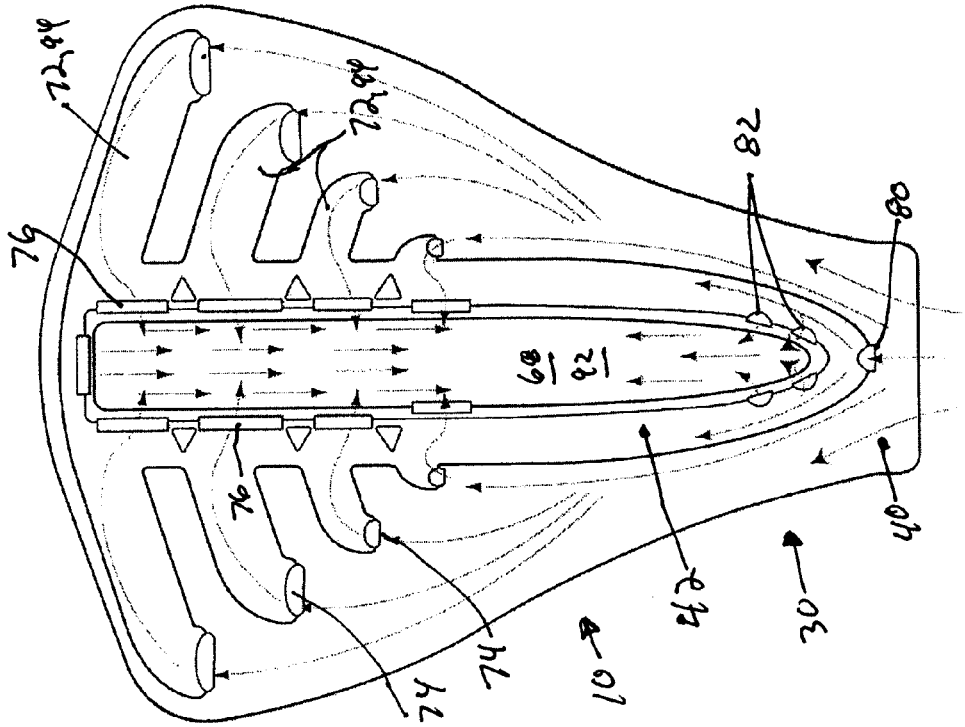
FIG. 6
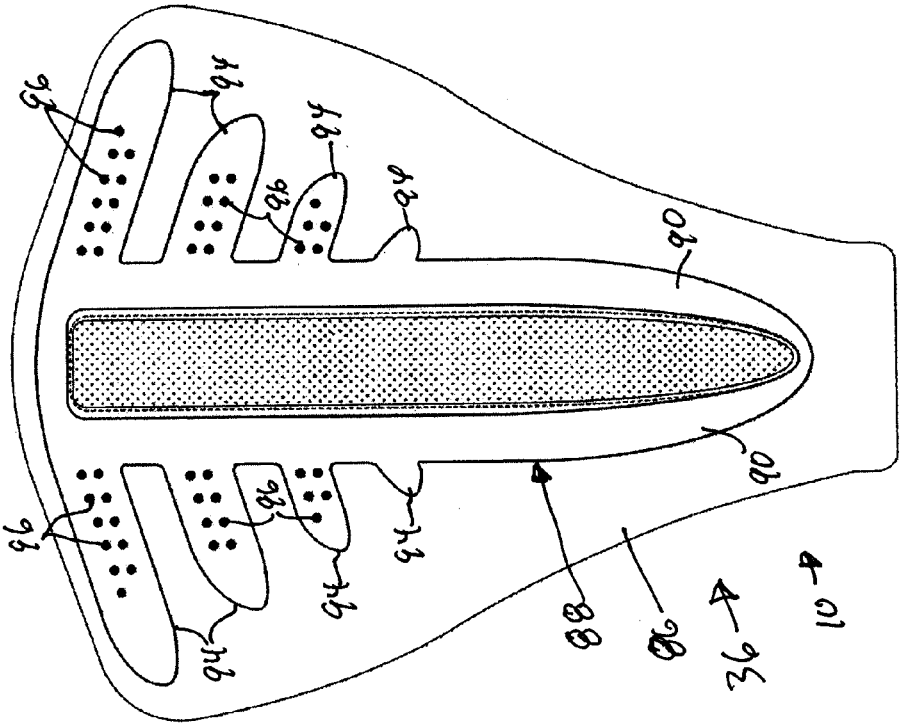
94
96
98
94
96
98
94
96
98

TORSO COOLING UNIT FOR PERSONAL WEAR

RELATED APPLICATION

This application is a nonprovisional application of U.S. Provisional Application No. 61/653,841, filed May 31, 2012. This application claims priority to said provisional application and incorporates the entire disclosure of said provisional application.

BACKGROUND OF THE INVENTION

This invention relates to a cooling unit that delivers air to a user's torso to help cool the user. The cooling unit may be used with a garment or may be used separately. As examples, a cooling unit of the present invention can deliver air into a first responder's uniform or a soldier's uniform, can be attached to or worn under a ballistic vest, or can be worn separately under a garment of any description. The embodiment illustrated below focuses on one use, that is, use in association with a ballistic vest of the type worn by a first responder. No modification of the vest is necessary. Such description is not limiting.

Ballistic vests (soft armor) are worn to help protect a police officer or other first responder from injury caused by bullets and other projectiles. The problem of overheating when wearing armor has been a challenge since such vests were first introduced. Such vests tend to be heavy and warm, as compared to ordinary clothing such as a uniform by itself. The present invention relates to a cooling unit that can make the user more comfortable, and that can help to prevent heat exhaustion, without any modification to the vest.

BRIEF DESCRIPTION OF THE DRAWINGS

FIG. 5 is a plan view of an inner panel that forms part of the manifold;

FIG. 6 is a view similar to FIG. 4 showing air flow in the manifold;

DETAILED DESCRIPTION

Figure 1:
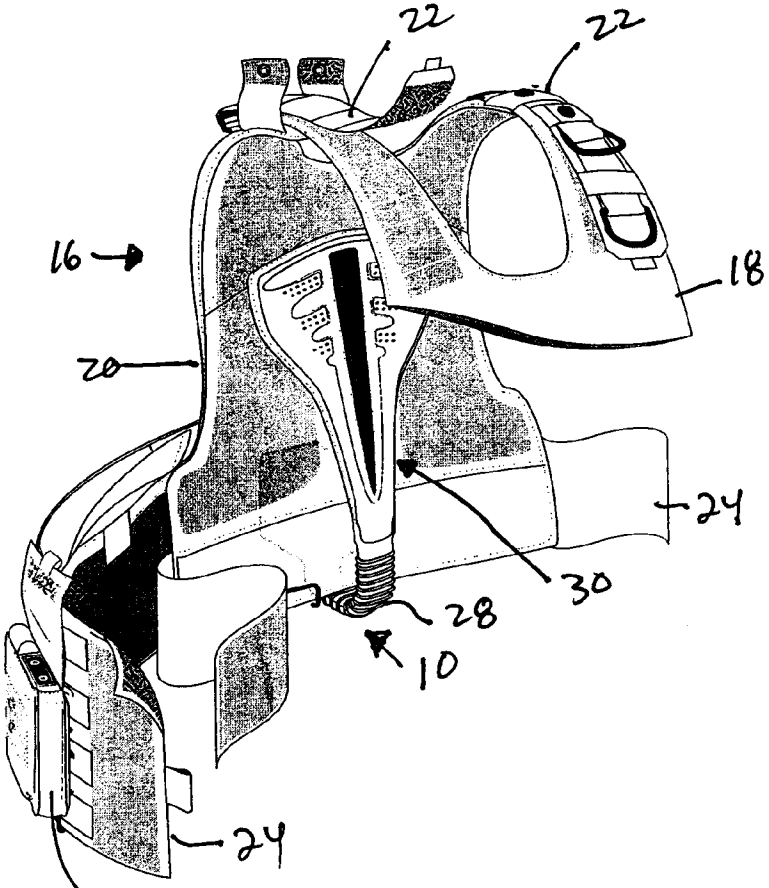
FIG. 1 is a front perspective view of a back panel of a ballistic vest with a cooling unit attached.

This invention relates to a cooling unit for a garment. In particular, this invention relates to a cooling unit that can be worn either alone or in association with a garment, such as a soft armor ballistic vest, to help to cool the user of the garment. The invention is applicable to cooling units of different and varied constructions. As representative of the invention, FIG. 1 illustrates a cooling unit 10 that is a first embodiment of the invention.

In general, the cooling unit 10 (FIGS. 1 and 2) includes a battery 12; a fan 14, powered by the battery, for blowing either ambient air or air that is cooled via evaporative cooling, to cool the user; a manifold 30 for distributing the blown air; and means for supporting the fan, the battery, and the manifold on the user in association with a garment, in this case, a ballistic vest 16.

The drawings illustrate schematically a ballistic vest 16 that can be any one of the many known types of ballistic vests. The vest 16 includes a front panel 18 and a back panel 20 held together by shoulder straps 22 and waist straps 24. In one embodiment, the cooling unit 10 is secured directly to the ballistic vest. Specifically, the manifold is secured to the inside of the back panel of the vest, with suitable connectors such as hook and loop connectors shown schematically at 15 in FIG. 2. Alternatively, in another embodiment (FIGS. 7 and 8), the cooling unit 10 can be supported on the user's torso by a separate harness inside the vest. The harness also allows the option of use without a ballistic vest being worn; firefighters are one example of such a possible application and use.

The fan 14 (FIG. 2) is preferably small and light weight, and energy efficient, while still being capable of producing the desired air flow. One suitable model is Orion brand fan model number ODB9733-12HB, which has five speed settings.

The battery 12 is preferably light weight and small and powerful enough to run the fan 14 for at least a significant portion of an officer's shift, if not the entire shift; the battery can then be recharged. One suitable battery 12 is Gerbing brand lithium polymer battery model BATLI124 or BATLI128, which can power the fan 14 for at least several hours on one charge. The outflow of the fan 14 flows downward through a hose 28, around the lower edge of the vest back panel 20, and upward into the lower end of the manifold 30.

Figure 3:
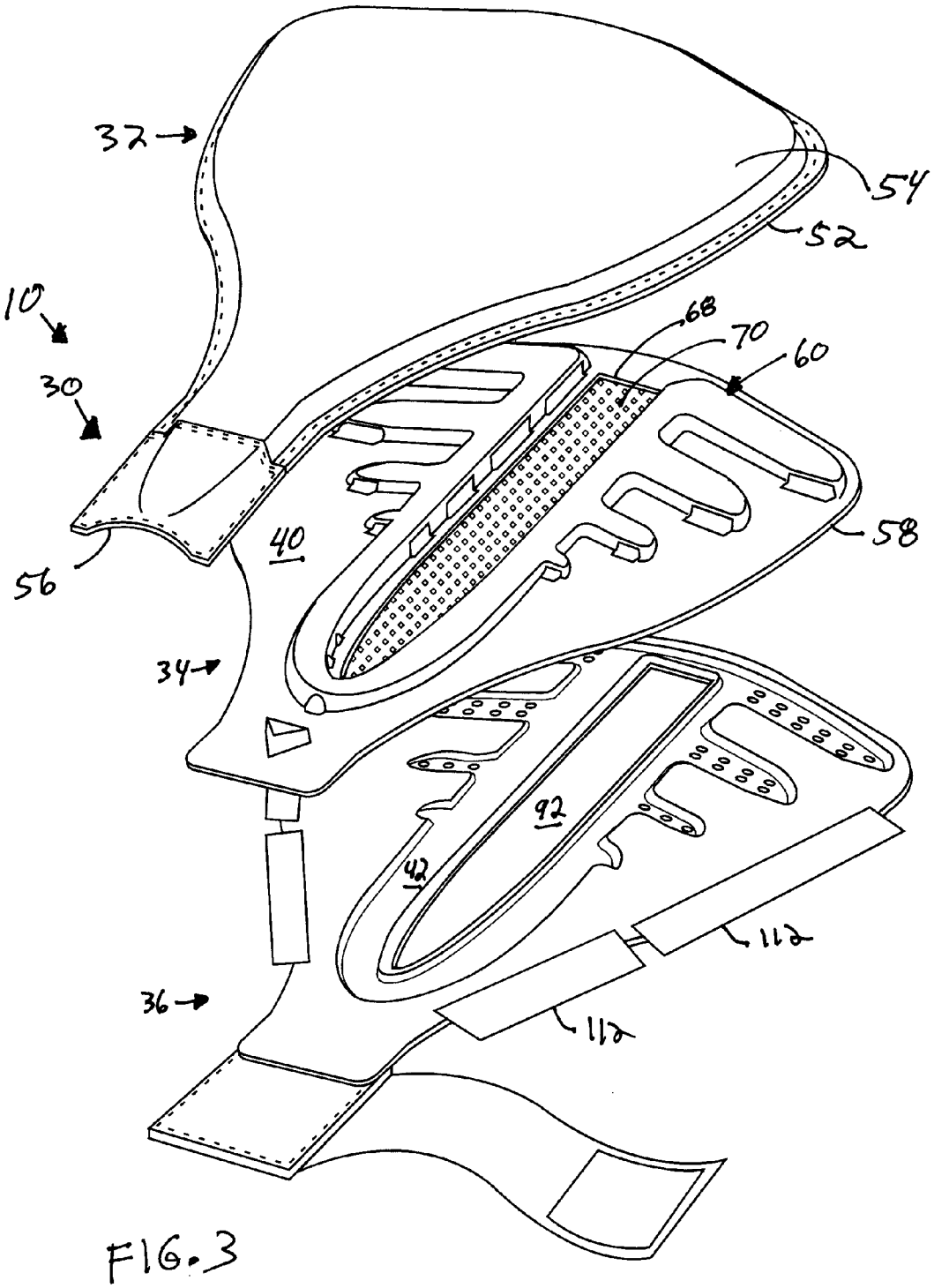
FIG. 3 is an exploded perspective view of a manifold that forms part of the cooling unit.

The manifold 30 (FIG. 3) can be made in any one of a plurality of different manners. In the illustrated embodiment, the manifold 30 is made from three main pieces—an outer panel 32, a central panel 34, and an inner panel 36. All three panels 32-36 of the manifold 30 have the same basic outline or configuration, similar to the shape of the head of a tennis racket, or a cobra head, for example, when viewed in plan as in FIG. 3.

The three panels 32-36 are fixed together around their peripheries, for example by sewing and/or adhesive. When the three panels 32-36 are fixed together, a volume 40 is formed between the outer panel and the central panel, denoted herein an air inlet chamber (described below in detail). In addition, a volume 42 is formed between the central panel and the inner panel, denoted herein an air outlet chamber (described below in detail). Air that is blown by the fan 14 is received into the inlet chamber 40. Air from the inlet chamber 40 flows within the manifold 30 into the outlet chamber 42, and flows from the outlet chamber 42 to the exterior of the cooling unit 10, in a manner described below in detail, to contact and cool the user's torso.

The outer panel 32 (FIG. 3) of the manifold 30 serves two primary purposes: as a cover for the cooling unit 10, and as the outside boundary of the inlet chamber 40. The outer panel 32 is impervious. The outer panel 32 has a projecting rim 52 (outer periphery) that is sewn to the central panel 34 and to the inner panel 36. The center portion 54 of the outer panel 32 is spaced apart from the central panel 34, to help form the inlet chamber 40. At its lower terminal end 56, the outer periphery 52 of the outer panel 32 projects away from the central panel 34, to allow air to flow from the hose 28 into the inlet chamber 40 that is defined between the outer panel and the central panel.

Figure 4:
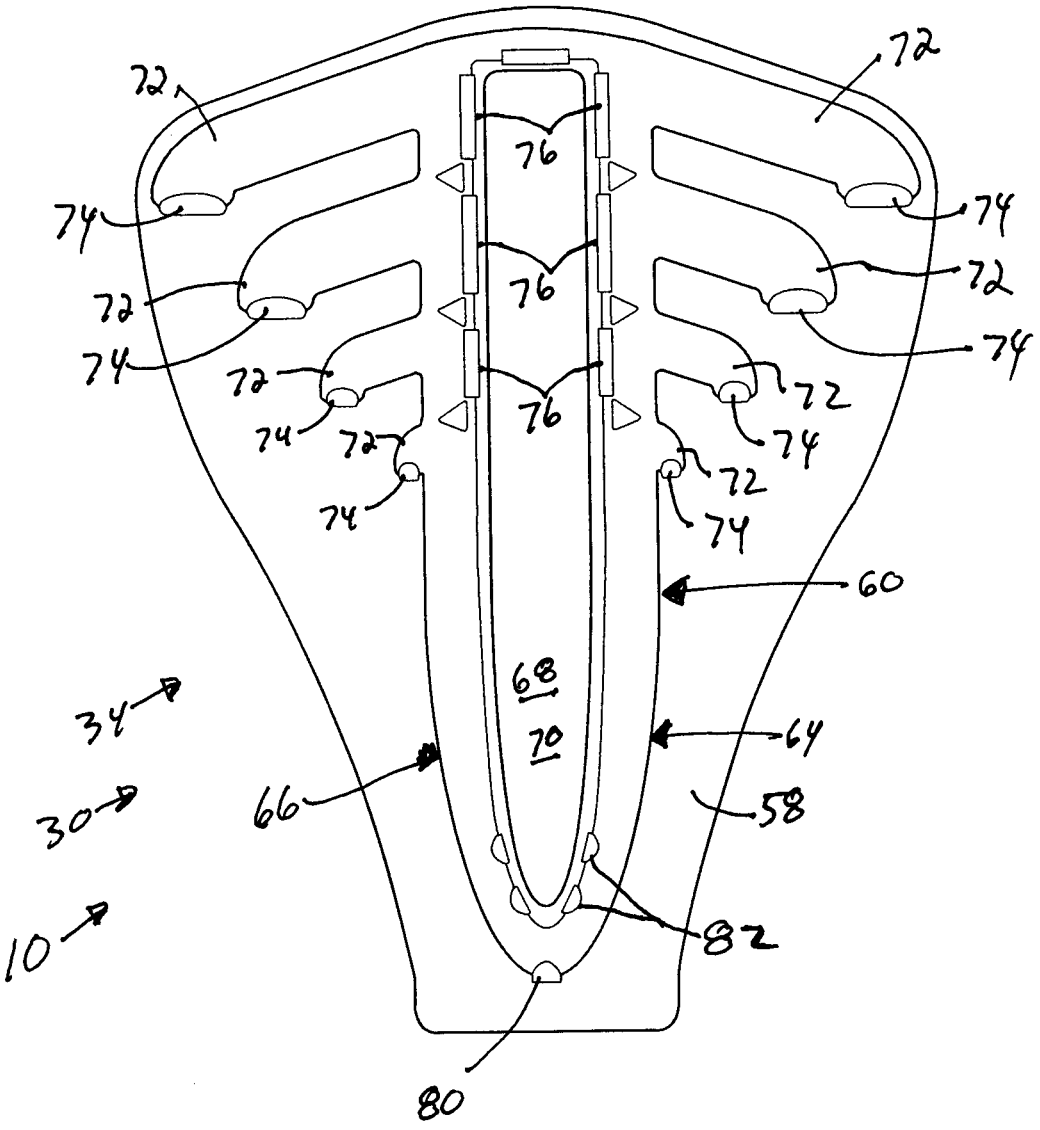
FIG. 4 is a plan view of a central panel that forms part of the manifold.

The central panel 34 (FIGS. 3 and 4) of the manifold 30 has a configuration similar in outline to that of the inner panel 36. The central panel 34 has a planar main panel portion 58 and a raised portion 60 that projects upward (as viewed in FIG. 3) from the main panel portion, that is, in a direction toward the outer panel 32.

The raised portion 60 of the central panel 34 is a collector channel that has a U-shaped configuration including first and second arms 64 and 66 that extend on either side of a central opening 68 of the central panel. A mesh panel 70 is sewn in the central opening 68. The collector channel has four fingers 72 on each side of the central opening 68, that extend laterally outward from the central opening. Each one of the fingers 72 has an air inlet opening 74 at or near its outer end.

In addition, the collector channel 60 of the central panel 34 has four air outlet openings 76 that are located inward of the fingers 72, adjacent the central opening 68 in the central panel 34. Air that flows into the air inlet openings 74, as described below, can flow through the collector channel 60 of the central panel 34 and thence out of the outlet openings 76, in a direction toward the central opening 68 of the central panel.

The central panel 34 also has a bottom air inlet opening 80 that is located at the bottom apex of the collector channel 60. Finally, several additional, small, air outlet openings 82 are formed in the collector channel 60, at a location just above the bottom air inlet opening 80.

The inner panel 36 (FIGS. 3 and 5) of the manifold has a configuration similar in outline to that of the outer and central panels 32 and 34, respectively. The inner panel 36 has a planar main panel portion 86, and a U-shaped diffuser channel 88 that projects from the main panel portion in a direction away from the central panel 34. The diffuser channel 88 of the inner panel 36 is similar in configuration to the collector channel 60 of the central panel 34. The diffuser channel 88 is generally U-shaped and includes two arms 90 that extend along opposite sides of a central opening 92 of the inner panel. The diffuser channel 88 has four fingers 94 that project laterally outward from the arms 90, in a direction away from the central opening 92 of the inner panel.

Each one of the three longer fingers 94 of the inner panel 36 also has a plurality of outer vent openings 96 that face toward the user's torso when the cooling unit 10 is being worn. Thus, air that flows into the fingers 94 of the inner panel 36, as described below, can flow through the outer vent openings 96 and toward the user's torso.

When the three panels 32, 34 and 36 of the manifold 30 are assembled together, the diffuser channel 88 of the inner panel underlies and is spaced apart from the collector channel 60 of the central panel. The central opening 92 of the inner panel 36 underlies the central opening 68 of the central panel 34. The fingers 94 of the inner panel 36 are similar in shape and configuration to, and underlie, the fingers 72 of the collector channel 60 of the central panel 34. Air that flows into the fingers 94 of the inner panel 36, as described below, can flow through the fingers 94 in a direction toward the central opening 92 of the inner panel 36.

When the manifold 30 is assembled, the open volume between the outer panel 32 and the central panel 34 forms the air inlet chamber 40 (FIG. 3) of the manifold. The hose 28, and thus the fan 14, are connected in fluid communication with the inlet chamber 40.

The planar portion 58 of the central panel 34 lies against the planar portion 86 of the inner panel 36. The collector channel 60 of the central panel 34 overlies the diffuser channel 88 of the inner panel 36. Thus, the respective volumes of the collector channel 60 and the diffuser channel 88 are joined to form the air outlet chamber 42, which is sealed between the inner panel 36 and the central panel 34.

FIG. 6 is an air flow diagram of the manifold 30. Air from the fan 14 flows through the tube 28 and into the bottom end of the manifold 30, and thence into the air inlet chamber 40 between the outer panel 32 and the central panel 34.

Air lows from the inlet chamber 40 flows through the various air inlet openings 74 and 92 in the central panel 34, into the air outlet chamber 42 that is located between the central panel and the inner panel 36. The flowing air then exits the outlet chamber 42 through the air outlet openings 76, flowing toward and through the central openings 68 and 92 in the central panel 34 and the inner panel 36, respectively, and onto the torso of the user.

When the manifold 30 is being worn, the central openings 68 and 92 are located over the user's spinal area. The flowing air helps to cool the user's spinal area. Cooling the spinal area is a very effective way to cool a user and to remove perspiration from, the user. In addition, some air flows from the outlet chamber 42 through the outer vent openings in the fingers of the inner panel 36, and into contact with the user's torso at a location laterally outward of the spinal area. The result is a powerful cooling unit that can help to maintain the comfort and health of a body armor user, without any modification to the body armor other than, perhaps, the simple addition of hook and loop patches for support. And the cooling unit can be worn completely unattached to the other garment, thus requiring no modifications at all to the existing garment.

Figure 2:
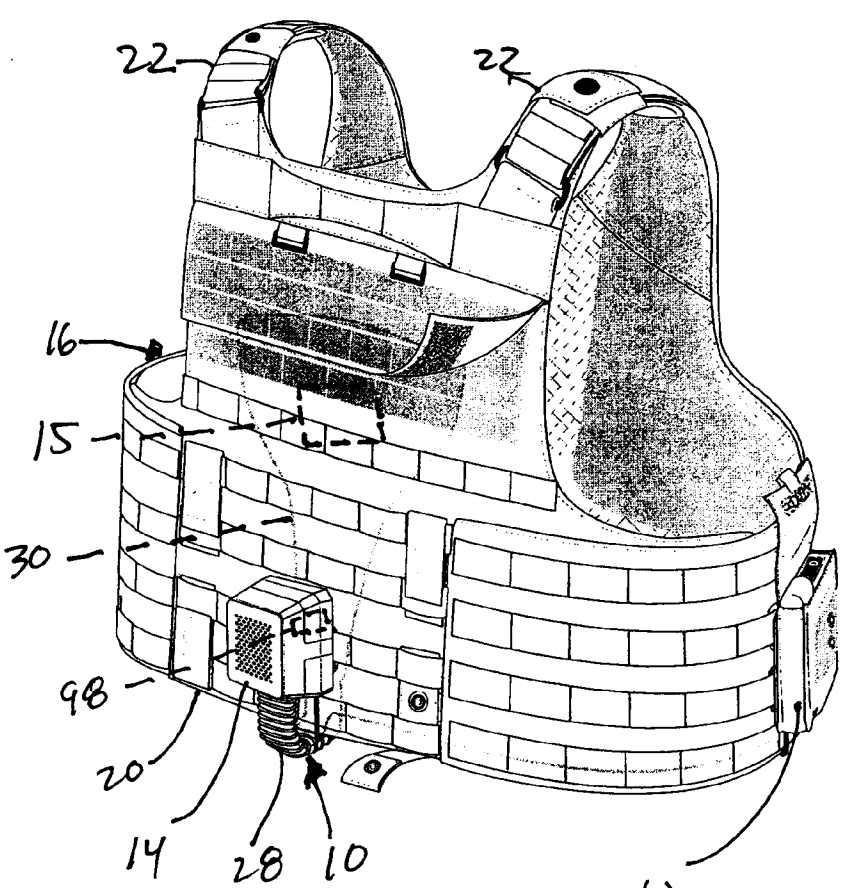
FIG. 2 is a back perspective view of the ballistic vest of FIG. 1 with the cooling unit attached.

A sponge can optionally be located in the housing of the fan, as shown schematically at 98 in FIG. 2. When the sponge 98 is soaked in water, an evaporative cooling system is provided which cools the air even more.

Figure 7:
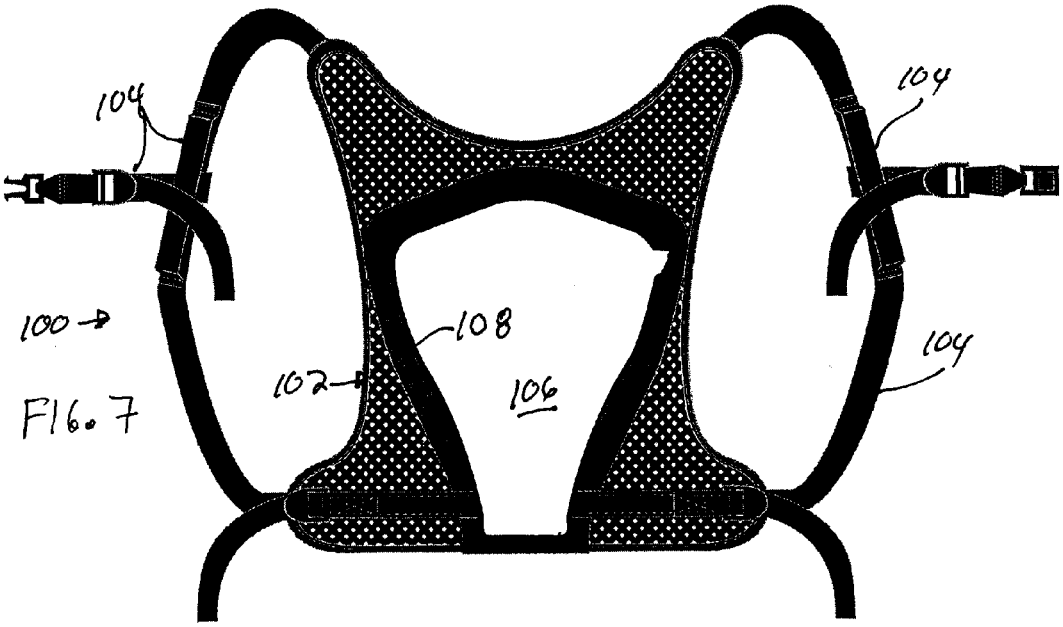
FIG. 7 is an outside view of a harness that can be used in association with the cooling unit.
Figure 8:
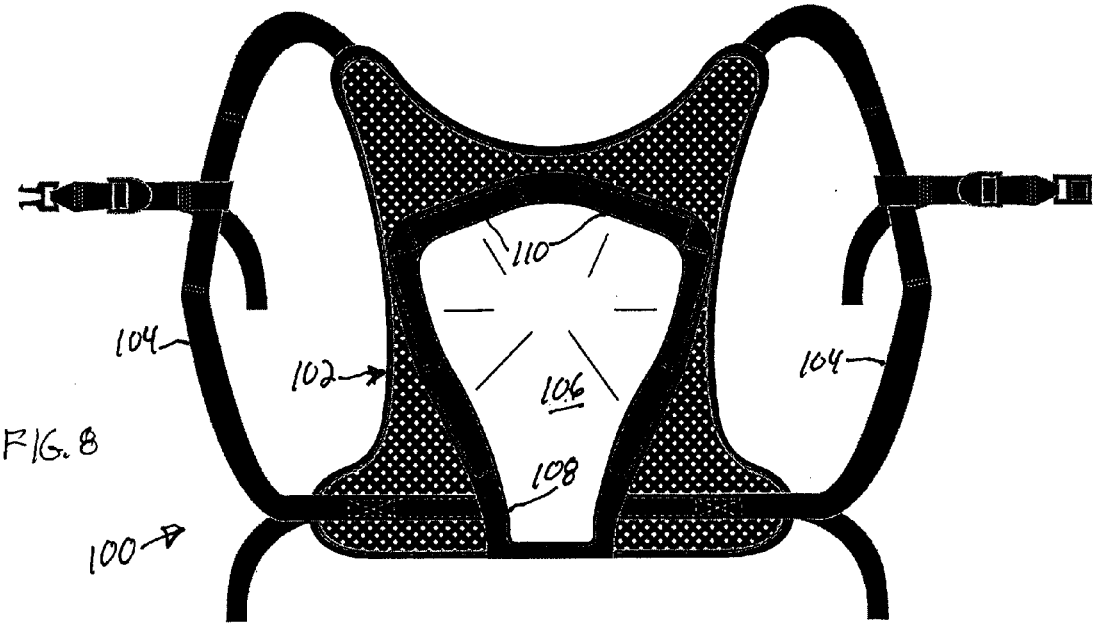
FIG. 8 is an inside view of the harness of FIG. 7.

In another embodiment, the cooling unit is supported on a harness 100 (FIGS. 7 and 8). The harness 100 (with its attached cooling unit 10) is worn by the user, under the vest 16 or by itself or with another garment, thus supporting the cooling unit on the user's torso. The harness 100 is generally of the type used in backpack hydration systems, one example of which is sold under the brand name 'Camelbak'. The harness 100 includes a center panel 102 and a number of straps 104 that extend around the user's torso to support the center panel on the user's back.

The center panel 102 of the harness 100 is ventilated. Specifically, the center panel 102 is made of a mesh material, and has a large central opening 106 in which no material is present. A frame 108 surrounds the opening. The frame 108 may be made of a stronger material than the mesh panel 102, to securely support the manifold 30. For example, the frame 108 may be made from rigid EVA foam with a nylon cover. The central opening 106 and the area of the harness center panel 102 are sized to accommodate the manifold 30.

On the outer surface of the frame 108 (facing away from the user's body), there are provided a number of hook patches 110. The inner panel 36 of the manifold 30 is provided with a plurality of loop patches 112 (FIG. 3) around its periphery for engagement with the hook patches 110 on the harness 100.

From the above description of the invention, those skilled in the art will perceive improvements, changes and modifications in the invention. For example, two or more of the panels may be made as one piece, for example by molding. Such improvements, changes and modifications within the skill of the art are intended to be covered by the appended claims.

The invention claimed is:

1. A cooling unit that can be worn on a user's torso by itself or in association with a garment such as a ballistic vest, the cooling unit comprising:

a fan for blowing ambient air; and a manifold connected with the fan for distributing the air to the torso;

the manifold formed of at least three panels that are secured together, the manifold including an outer panel, a central panel, and an inner panel that is closest to the user's torso when the cooling unit is being worn;

the outer panel and the central panel defining between them an air inlet chamber that is in fluid communication with the fan for receiving air blown by the fan;

the central panel and the inner panel defining between them an air outlet chamber that is in fluid communication with the air inlet chamber and that directs air from the air inlet chamber to a central opening in the inner panel thereby to contact a spinal area of the user's torso;

wherein the air outlet chamber comprises a collector channel on the central panel and a diffuser channel on the inner panel whose volumes join to form the air outlet chamber.

2. The cooling unit as set forth in claim 1, wherein the collector channel and the diffuser channel are each U-shaped with legs that extend on either side of the central opening in the inner panel.

3. The cooling unit as set forth in claim 2, wherein the collector channel has a plurality of fingers that have air inlet openings, the fingers directing air from the air inlet openings into the legs of the collector channel, the collector channel having air outlet openings adjacent the central opening of the inner panel for directing the blown air through the central opening of the inner panel.

4. The cooling unit as set forth in claim 1, wherein the diffuser channel on the inner panel includes a plurality of fingers extending from the legs of the diffuser channel, the fingers on the diffuser channel having air outlet openings spaced outward from the central opening of the inner panel for directing the blown air through the air outlet openings on the back of the user's torso laterally outward of the central opening of the inner panel.

* * * * *